US011172738B2

(12) United States Patent
Li et al.

(10) Patent No.: US 11,172,738 B2
(45) Date of Patent: Nov. 16, 2021

(54) CONNECTION STRUCTURE AND WEARING DEVICE

(71) Applicant: LUXSHARE ELECTRONIC TECHNOLOGY (KUNSHAN) LTD., Kunshan (CN)

(72) Inventors: Kai-Hua Li, Kunshan (CN); Jia-Le Cai, Kunshan (CN); Tong Yu, Kunshan (CN)

(73) Assignee: LUXSHARE ELECTRONIC TECHNOLOGY (KUNSHAN) LTD., Kunshan (CN)

( * ) Notice: Subject to any disclaimer, the term of this patent is extended or adjusted under 35 U.S.C. 154(b) by 264 days.

(21) Appl. No.: 16/441,805

(22) Filed: Jun. 14, 2019

(65) Prior Publication Data

US 2020/0000184 A1 Jan. 2, 2020

(30) Foreign Application Priority Data

Jun. 28, 2018 (CN) ..... 201810683176.X

(51) Int. Cl.

| | |
|---|---|
| ***A44C 5/02*** | (2006.01) |
| ***A44C 5/14*** | (2006.01) |
| ***A44C 5/20*** | (2006.01) |
| ***G04G 17/04*** | (2006.01) |
| ***G04G 17/08*** | (2006.01) |

(52) U.S. Cl.

CPC ..... *A44C 5/02* (2013.01); *A44C 5/14* (2013.01); *A44C 5/2061* (2013.01); *G04G 17/04* (2013.01); *G04G 17/08* (2013.01)

(58) Field of Classification Search

CPC .. G04B 37/1486; G04B 37/14; A44C 5/2061; A44C 5/02; A44C 5/14; A44C 5/2052; A44C 5/22; G04G 17/04; G04G 17/08; G04G 17/02

USPC ..... 368/282

See application file for complete search history.

(56) References Cited

U.S. PATENT DOCUMENTS 2,807,855 A * 10/1957 Rodriguez ..... A44C 5/14 24/265 B
4,217,681 A * 8/1980 Grohoski ..... A44C 5/14 224/164
6,041,479 A 3/2000 Colpo
(Continued)

FOREIGN PATENT DOCUMENTS

EP 3213654 A1 9/2017

*Primary Examiner* — Edwin A. Leon

(74) *Attorney, Agent, or Firm* — Birch, Stewart, Kolasch & Birch, LLP

(57) ABSTRACT

A connection structure and a wearing device are provided. The connecting structure includes a connecting member, a latching member, an engaging member, and an elastic member; one of two ends of the latching member is rotatably connected with the connecting member, and the other end of the latching member is provided with a latching portion; the engaging member is provided with an engaging portion corresponding to the latching portion, and the elastic member can engage the latching portion with the engaging portion. The wearing device includes the connection structure. The latching member is rotatably connected with the connecting member so as to enable the latching member to be quickly separated from the engaging member, and two mechanisms could be connected and separated from each other quickly with the connection structure.

9 Claims, 7 Drawing Sheets

(56) References Cited

U.S. PATENT DOCUMENTS

| | | | | |
|---|---|---|---|---|
| 7,380,979 | B2 * | 6/2008 | Hiranuma | A44C 5/14<br>368/282 |
| 9,877,549 | B2 * | 1/2018 | Perkins | F16B 2/14 |
| 10,359,739 | B2 * | 7/2019 | Vuille | G04B 37/1486 |

* cited by examiner

CONNECTION STRUCTURE AND WEARING DEVICE

CROSS-REFERENCE TO RELATED APPLICATION

This non-provisional application claims priority under 35 U.S.C. § 119(a) to Patent Application No. 201810683176.X filed in China, P.R.C. on Jun. 28, 2018, the entire contents of which are hereby incorporated by reference.

BACKGROUND

Technical Field

The present invention relates to the technical field of wearing devices, and in particular, to a connection structure and a wearing device.

Related Art

With the development of science and technologies, there have been continuous innovations in types and functions of watches and bracelets, and the watches and bracelets are widely used by consumers because of their decorative and practical features. A watch can allow a user to know time conveniently, and it also plays a decorative role, thereby improving temperament and style of the user.

Leather and metal are generally used for wristbands of the watches and bracelets. In the prior art, a wristband and a dial of a watch are fixedly connected, and the color and material of the wristband cannot be changed into different ones according to clothes. Further, the users are no longer limited to adult office workers. To suit different types of consumers, the main form is to replace wristbands of different shapes, styles, and colors. Therefore, a watch or a bracelet with a replaceable wristband function is designed for different types of consumer groups to wear.

Currently, a wristband part of a bracelet in the market is mainly sleeved by a watch case. The wristband and the watch case are clamped in a spring manner to fix and replace the wristband. This manner for changing the wristband is inconvenient and time-consuming.

Therefore, a connection structure and a wearing device are needed to resolve the foregoing technical problem.

SUMMARY

One of the objectives of the present invention is to provide a connection structure, to implement quick connection and separation. To achieve the objective, the technical solution used in the present invention is as follows:

A connection structure includes a connecting member, a latching member and an elastic member. One of two ends of the latching member is rotatably connected with the connecting member, and the other end of the latching member is provided with a latching portion. An engaging member is provided with an engaging portion corresponding to the latching portion. The elastic member can engage the latching portion with the engaging portion. The latching member is rotatably connected with the connecting member, and the elastic member enables the latching portion and the engaging portion to be always tightly engaged with each other when no external force is applied to the latching member; the latching member is rotatably connected with the connecting member so as to enable the latching member to be quickly separated from the engaging member, and two mechanisms could be connected and separated from each other quickly with the connection structure.

In an embodiment, the connection structure further includes a sliding block. The sliding block can slide relatively to the engaging member. One side of the sliding block near the engaging member is provided with a stirring pin. The stirring pin is corresponding to the latching member. When the sliding block slides, the latching member can be driven to rotate so that the latching portion is separated from the engaging portion.

In an embodiment, the connection structure further includes an upper housing. The connecting member is disposed on the upper housing. A locating pin is disposed on the upper housing. A locating slot corresponding to the locating pin is disposed on the engaging member.

In an embodiment, the connection structure further includes a lower housing. The lower housing is fixedly connected with the upper housing. A chute is disposed on the lower housing. The sliding block is slidably disposed in the chute, and a through hole is disposed on a bottom surface of the chute.

In an embodiment, a stirring block is disposed on one side of the sliding block near the bottom surface of the chute, and the stirring block is located in the through hole.

In an embodiment, the elastic member is a torsion spring. A slot is disposed on the latching member. The torsion spring is sleeved on the connecting member, and the latching member is sleeved on the torsion spring. Two lever arms of the torsion spring are disposed respectively in the slots of the two latching members.

In an embodiment, a first groove is disposed on one side of the latching member near the engaging member, and two second grooves are disposed on one side of the engaging member near the latching member. The second groove joints the first groove to form an accommodating chamber, and the stirring pin is located in the accommodating chamber.

The other objective of the present invention is to provide a wearing device capable of quickly replacing wristbands. To achieve the objective, the technical solution is as follows:

A wearing device includes the connection structure described above.

In an embodiment, a housing of the wearing device is fixedly connected with an engaging member, and a wristband of the wearing device is fixedly connected with a connecting member.

In an embodiment, the housing and the engaging member are formed integrally.

The beneficial effects of the present invention are: the latching member is rotatably connected with the connecting member, and the elastic member enables the latching portion and the engaging portion to be always tightly engaged with each other when no external force is applied to the latching member; and the latching member is rotatably connected with the connecting member so as to enable the latching member to be quickly separated from the engaging member, and two mechanisms could be connected and separated from each other quickly with the connection structure.

When the sliding block slides, the stirring pin can apply an external force to the latching member to separate the latching portion from the engaging portion so that the separation between the latching member and the engaging member is more effortless and convenient.

DETAILED DESCRIPTION

The technical solutions of the present invention will be described below clearly and completely with reference to the drawings. Apparently, the embodiments described are some of the embodiments of the present invention, rather than all the embodiments. Based on the embodiments of the present invention, all the other embodiments obtained, without making any creative efforts, by a person of ordinary skill in the related art shall fall within the protection scope of the present invention.

Figure 1:
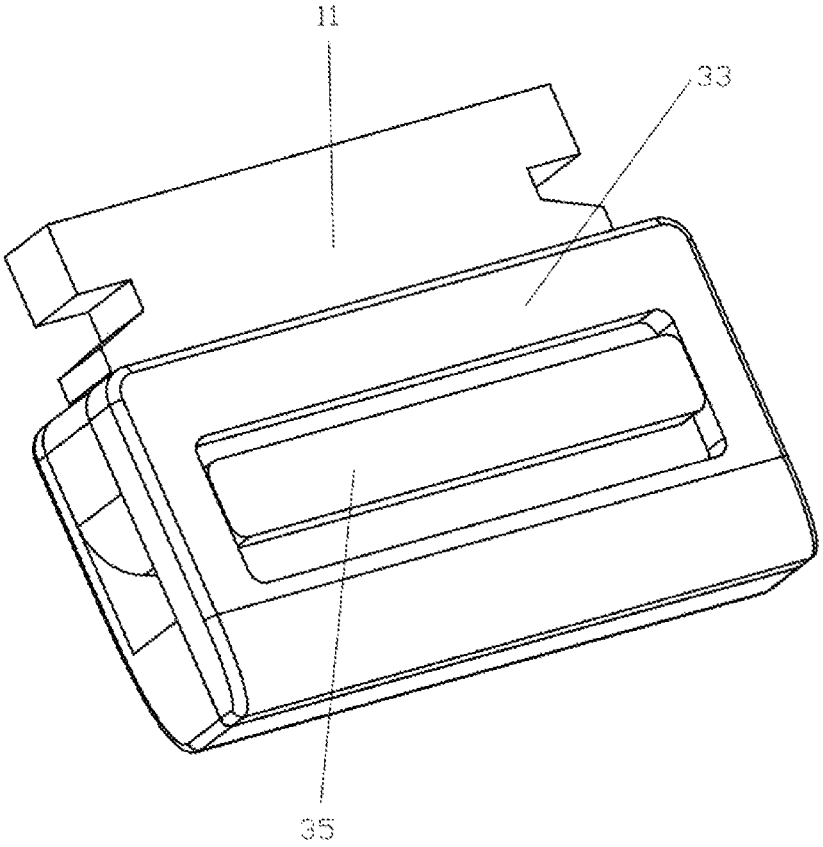
FIG. 1 is a schematic structural view of a connection structure according to an embodiment of the present invention.
Figure 2:
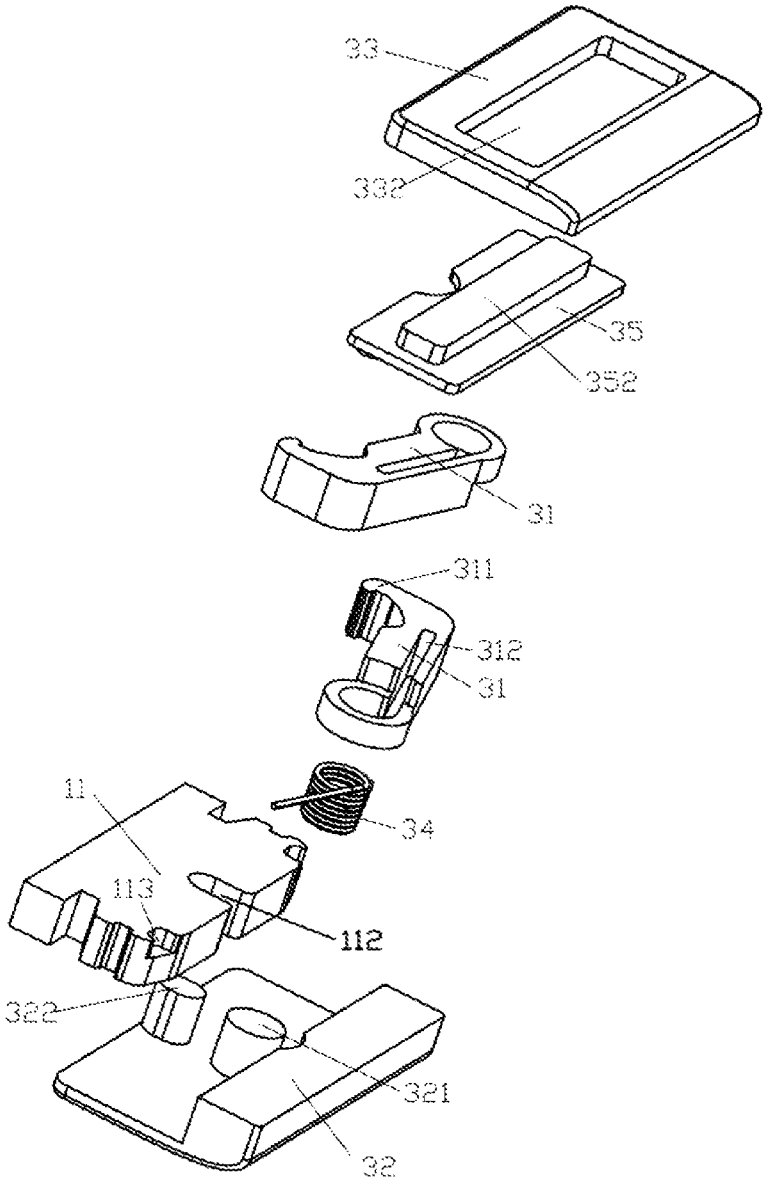
FIG. 2 is a structural exploded view of a connection structure according to an embodiment of the present invention.
Figure 3:
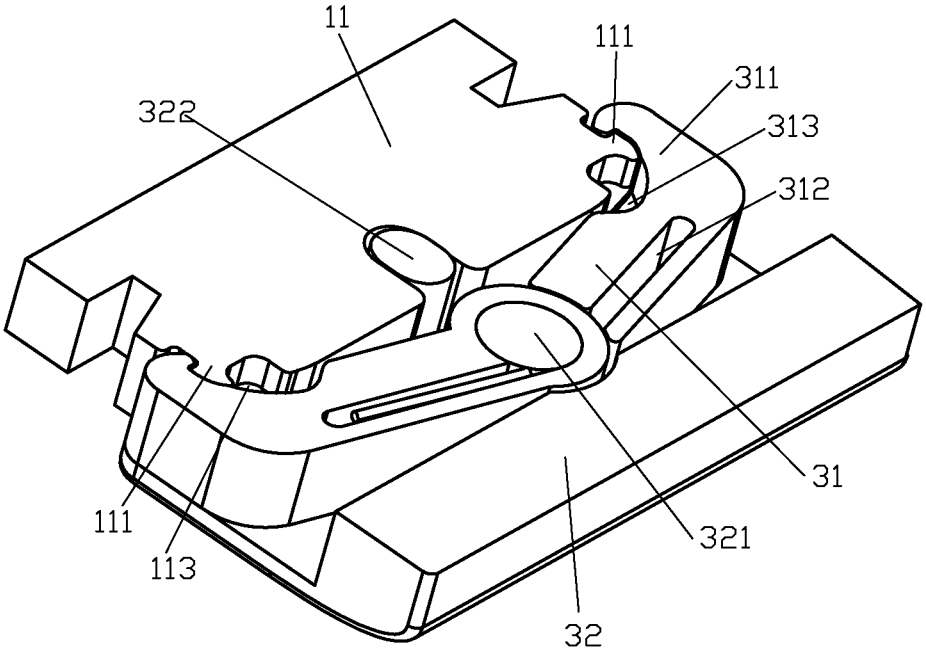
FIG. 3 is a schematic structural view from a view angle of a part of a connection structure according to an embodiment of the present invention.
Figure 4:
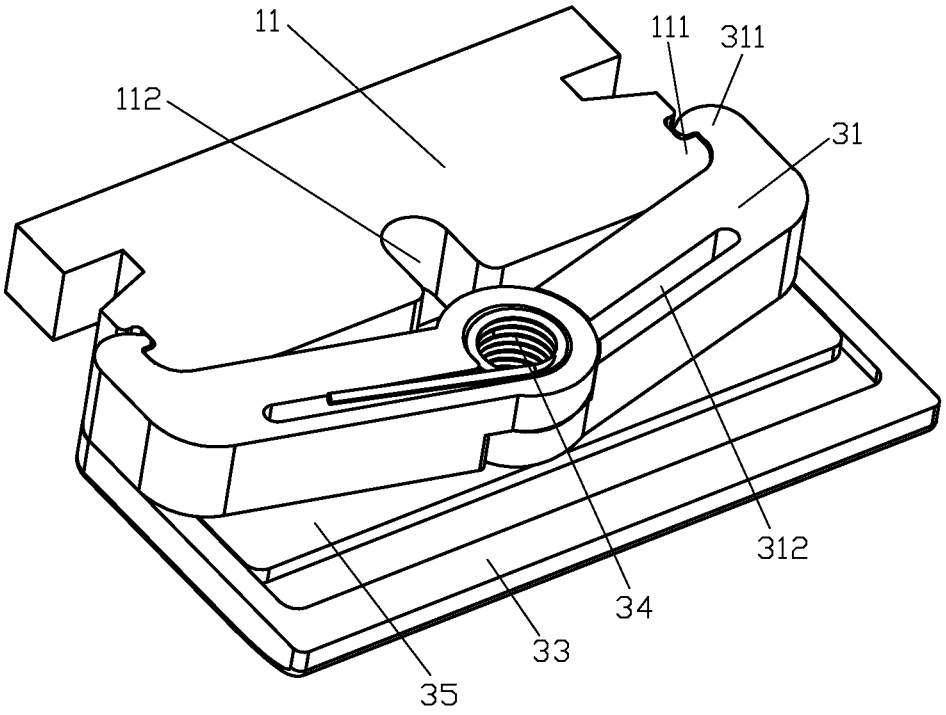
FIG. 4 is a schematic structural view from another view angle of a part of a connection structure according to an embodiment of the present invention.

As shown in FIG. 1 to FIG. 6, this embodiment discloses a connection structure, including a connecting member 321, two latching members 31, an engaging member 11, an upper housing 32, a lower housing 33, a sliding block 35, and an elastic member. As shown in FIG. 2 to FIG. 4, one of two ends of the latching member 31 is rotatably connected with the connecting member 321 on the upper housing 32, and the other end of the latching member 31 is provided with a latching portion 311; and each of two sides of the engaging member 11 is provided with an engaging portion 111 corresponding to the latching portion 311. The latching portion 311 is hook-shaped, and the engaging portion 111 of the engaging member 11 is also hook-shaped. The elastic member can enable the latching portion 311 of the latching member 31 and the engaging portion 111 of the engaging member 11 to be engaged with each other, thereby connecting the connecting member 321 with the engaging member 11. Refer to FIG. 3 and FIG. 4 for more details.

The latching member 31 is rotatably connected with the connecting member 321, and the elastic member can apply a pretension force to the latching member 31 to preset the latching portion 311 and the engaging portion 111 to be tightly engaged with each other. The latching member 31 is rotatably connected with the connecting member 321, so that the latching member 31 can rotate with the connecting member 321 as the center and separate the latching member 31 from the engaging member 11 quickly. Two mechanisms could be connected and separated from each other quickly with the connection structure. The latching member 31 rotating with the connecting member 321 as the center means that the latching member 31 performs a slight revolution or rotation, such as deflection or swing, with the connecting member 321 as the center.

As shown in FIG. 2 to FIG. 4, the elastic member is provided with two lever arms. One lever arm abuts against one latching member 31, and the other lever arm abuts against the other latching member 31. The two lever arms can enable the latching portions 311 and the engaging portions 111 to be tightly engaged with each other. Preferably, the elastic member in this embodiment is a torsion spring 34, and the latching member 31 is provided with a slot 312. The torsion spring 34 is sleeved on the connecting member 321, and the latching member 31 is sleeved on the torsion spring 34. The two lever arms of the torsion spring 34 are disposed respectively in the slots 312 of the two latching members 31. The lever arms of the torsion spring 34 abut against side walls of the slots 312. Under the effect of the two lever arms of the torsion spring 34, the latching portions 311 of the two latching members 31 can move towards a direction to clamp the engaging member 11, so that the latching portions 311 and the engaging portions 111 can be engaged with each other. Certainly, the elastic member can also be a piece of steel with one end bent.

The upper housing 32 is fixedly connected with one end of the connecting member 321, and the upper housing 32 and the connecting member 321 are formed integrally. The upper housing 32 is provided with a locating pin 322, and the engaging member 11 is provided with a locating slot 112 corresponding to the locating pin 322. When the latching member 31 is latched with the engaging member 11, the locating pin 322 and the locating slot 112 play the roles of locating and alignment. The lower housing 33 is fixedly connected with the upper housing 32. The upper housing 32 and the lower housing 33 can be welded together through laser or ultrasound.

Figure 5:
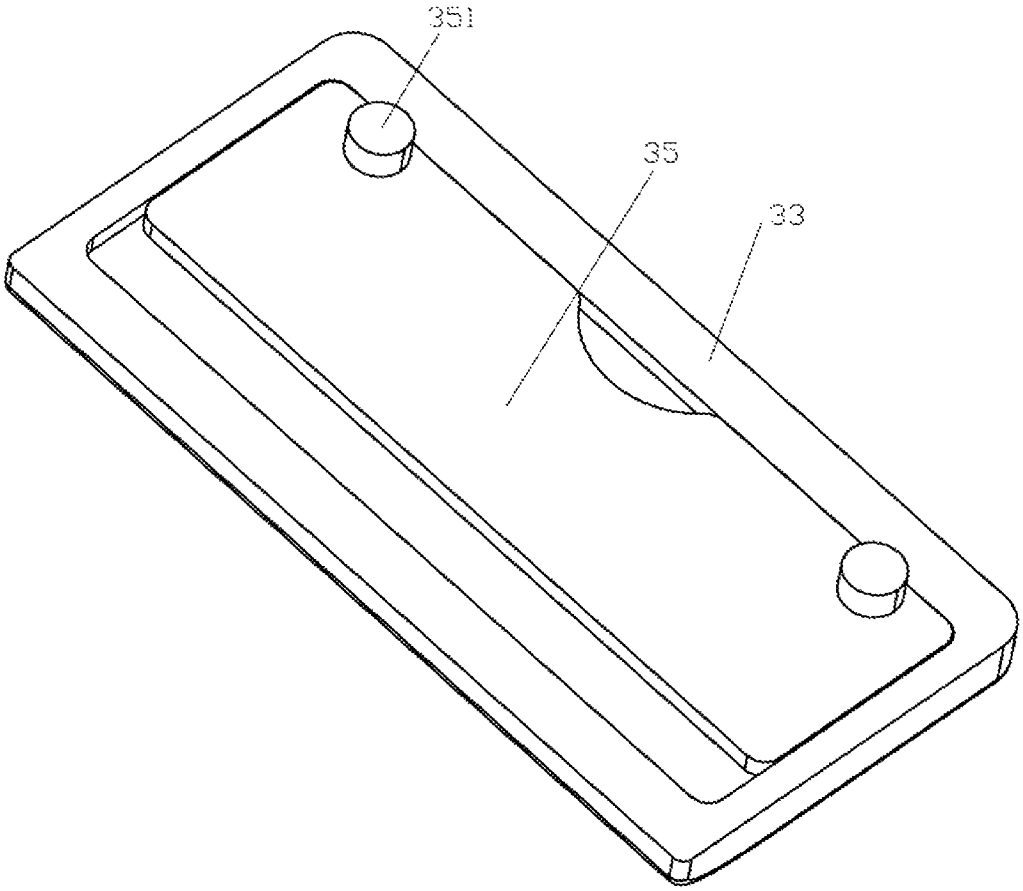
FIG. 5 is a schematic structural view of a lower housing and a sliding block according to an embodiment of the present invention.
Figure 6:
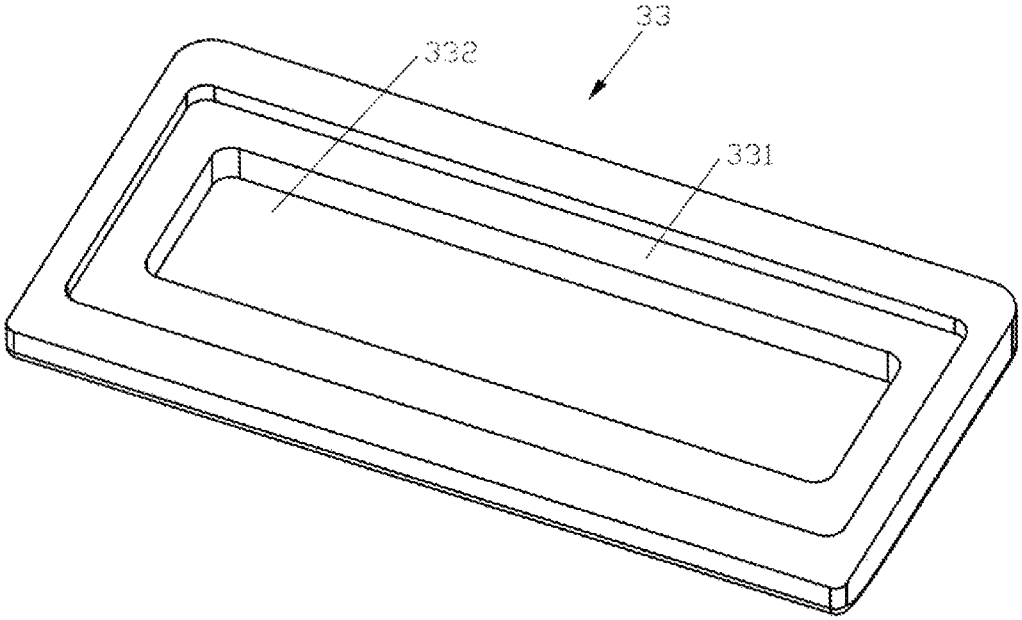
FIG. 6 is a schematic structural view of a sliding block according to an embodiment of the present invention.

Referring to FIG. 2, FIG. 5, and FIG. 6, a chute 331 is disposed on one side of the lower housing 33 near the upper housing 32. The sliding block 35 is slidably disposed in the chute 331. The sliding block 35 can move, in a direction towards or away from the engaging member 11, in the chute 331. A through hole 332 is disposed on a bottom surface of the chute 331. The cross-section shape of the through hole 332 is square. A stirring block 352 is disposed on one side of the sliding block 35 near the lower housing 33. The stirring block 352 is located in the through hole 332 and can slide in the through hole 332, that is, the sliding block 35 slides in the chute 331.

Two stirring pins 351 are disposed on one side of the sliding block 35 near the upper housing 32. A first groove 313 is disposed on one side of the latching member 31 near the engaging member 11, and two second grooves 113 are disposed on one side of the engaging member 11 near the latching member 31. The two second grooves 113 are corresponding to locations of the first grooves 313 on the two latching members 31 respectively. A first groove 313 joints a second groove 113 in the corresponding location to form an accommodating chamber. The two stirring pins 351 are located in the two accommodating chambers. The two latching members 31 are a first latching member and a second latching member. The first latching member and the second latching member have the same structure, except that the locations of the two first grooves 313 are set differently.

In this embodiment, the two stirring pins 351 of the sliding block 35 are located respectively in the accommodating chambers of the two latching members 31, that is, there is a matching relationship between the stirring pin 351 and the accommodating chamber. The matching relationship means that after the stirring pin 351 and the accommodating are matched, there is a gap or interference between a matching surface of the stirring pin 351 and the first groove 313 and a matching surface of the stirring pin 351 and the second groove 113.

The sliding block is stirred to slide in a direction away from the engaging member 11. The two stirring pins 351 abut against the inner surfaces of the two latching members 31 respectively, thereby driving the two latching members 31 to rotate with the connecting member 321 as the center. The rotation of the two latching members 31 drives the two latching portions 311 to move in a direction away from the engaging member 11. The latching portion 311 of the latching member 31 falls off from the engaging portion 111 of the engaging member 11, and the latching member 31 and the engaging member 11 are disconnected, thereby disconnecting the connection between the upper housing 32 and the engaging member 11 and the connection between the lower housing 33 and the engaging member 11.

In this embodiment, the sliding block 35 may drive the two latching members 31 to rotate, but this is only one possible option of the specific implementation manners. Another option can be that the sliding block 35 only drives one latching member 31 to rotate, so as to make the latching portion 311 of the latching member 31 fall off from the engaging portion 111 of the engaging member 11 so that the latching member 31 and the engaging member 11 are disconnected, thereby disconnecting the connection between the upper housing 32 and the engaging member 11 and the connection between the lower housing 33 and the engaging member 11.

Figure 7:
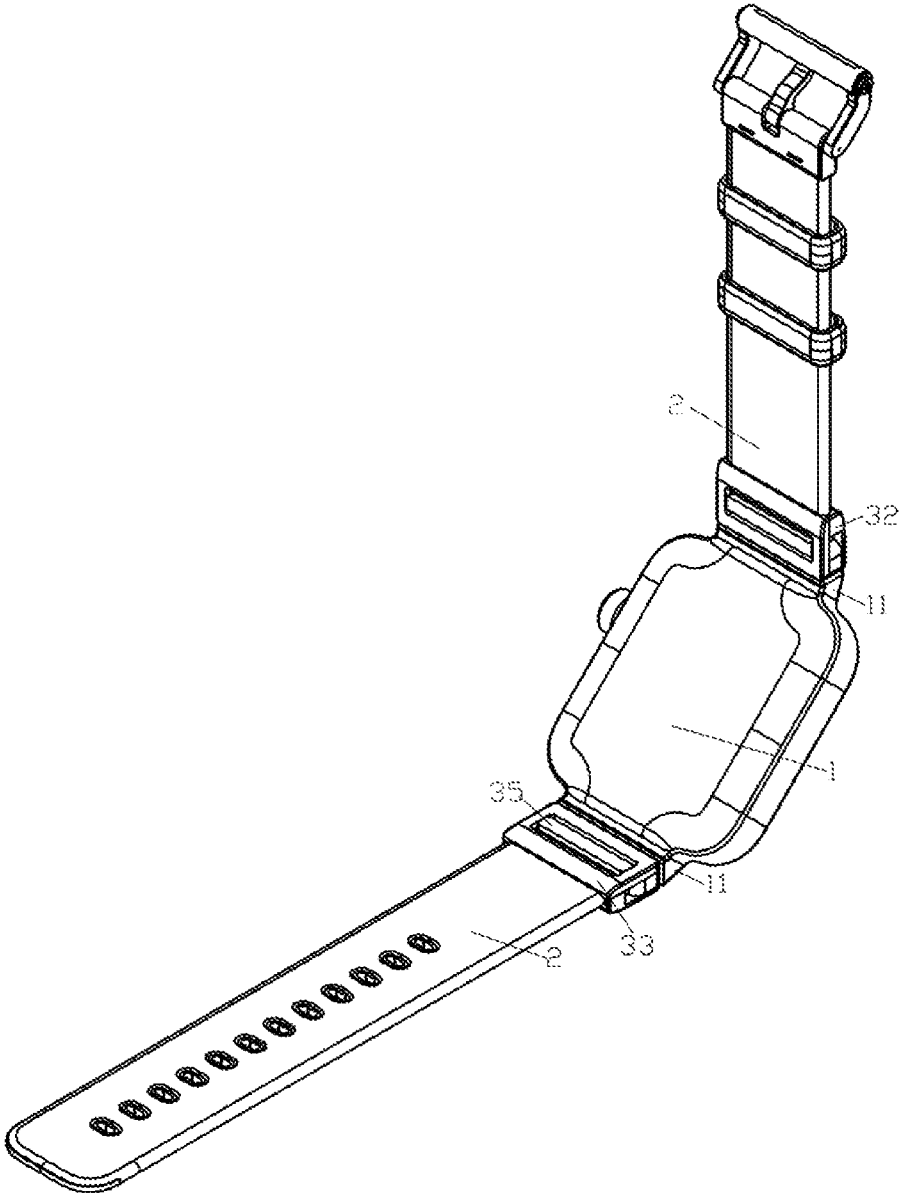
FIG. 7 is a schematic structural view of a wearing device according to an embodiment of the present invention.

As shown in FIG. 7, this embodiment further discloses a wearing device, which uses the foregoing connection structure. Preferably, the wearing device in this embodiment is a watch, or may be a bracelet or the like. A housing 1 of the wearing device is fixedly connected with an engaging member 11. Preferably, in this embodiment, the housing 1 and the engaging member 11 are formed integrally. A wristband 2 of the wearing device is fixedly connected with a connecting member 321. Preferably, in this embodiment, the wristband 2 is fixedly connected with the connecting member 321 through an upper housing 32. One end of the wristband 2 is provided with a plurality of connecting holes. Connecting shafts corresponding to the connecting holes are disposed on the upper housing 32. After the wristband 2 is buckled onto the upper housing 32, welding is performed on the upper housing 32 and the lower housing 33. The wearing device allows the wristband 2 to be replaced quickly according to wearing needs.

It should be noted that the foregoing descriptions are only the preferred embodiments of the present invention and the technical principle used in the present invention. A person of ordinary skill in the related art of the present invention should understand that the present invention is not limited to the specific embodiments described herein, and for a person of ordinary skill in the related art of the present invention, decided changes, readjustments and replacements of all kinds can be made without falling apart from the protection scope of the present invention. Therefore, although the present invention is described in detail through the foregoing embodiments, the present invention is not limited to the foregoing embodiments and can also include more other equivalent embodiments without falling apart from the conception of the present invention, and the scope of the present invention is determined by the attached claims.

What is claimed is:

1. A connection structure, comprising:
a connecting member;
a latching member, one of two ends of the latching member is rotatably connected with the connecting member, and the other end of the latching member is provided with a latching portion;
an engaging member, provided with an engaging portion corresponding to the latching portion;
an elastic member, wherein the elastic member can engage the latching portion with the engaging portion; and
a sliding block, wherein the sliding block can slide relatively to the engaging member, a stirring pin is disposed on one side of the sliding block near the engaging member, the stirring pin abuts against the latching member, and when the sliding block slides, the stirring pin is pressed against the engaging member, and the latching member can be driven to rotate with the connecting member as the center so that the latching portion is separated from the engaging portion.

2. The connection structure according to claim 1, further comprising an upper housing, wherein the connecting member is disposed on the upper housing, and a locating pin is disposed on the upper housing.

3. The connection structure according to claim 2, further comprising a lower housing, wherein the lower housing is fixedly connected with the upper housing, a chute is disposed on the lower housing, the sliding block is slidably disposed in the chute, and a through hole is disposed on a bottom surface of the chute.

4. The connection structure according to claim 3, wherein a stirring block is disposed on one side of the sliding block near the bottom surface of the chute, and the stirring block is located in the through hole.

5. The connection structure according to claim 1, wherein the elastic member is a torsion spring, a slot is disposed on the latching member, the torsion spring is sleeved on the connecting member, the latching member is sleeved on the torsion spring, and a lever arm of the torsion spring is disposed in the slot.

6. The connection structure according to claim 1, wherein a first groove is disposed on one side of the latching member near the engaging member, a second groove is disposed on one side of the engaging member near the latching member, the second groove joints the first groove to form an accommodating chamber, and the stirring pin is located inside the accommodating chamber.

7. A wearing device, comprising the connection structure according to claim 1.

8. The wearing device according to claim 7, further comprising a housing, wherein the housing is fixedly connected with the engaging member, the wearing device further comprises a wristband, and the wristband is fixedly connected with the connecting member.

9. The wearing device according to claim 8, wherein the housing and the engaging member are formed integrally.

* * * * *